US005958218A

United States Patent [19]

Hunter et al.

[11] Patent Number: 5,958,218

[45] Date of Patent: Sep. 28, 1999

[54] TWO-STAGE HYDROPROCESSING REACTION SCHEME WITH SERIES RECYCLE GAS FLOW

[75] Inventors: Michael G. Hunter, Katy, Tex.; Kenneth W. Goebel, Schnecksville, Pa.

[73] Assignee: The M. W. Kellogg Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,456

[22] Filed: Jan. 22, 1996

[51] Int. Cl.[6] ..... C10G 51/06; C07C 1/00; B01G 8/04

[52] U.S. Cl. ..... 208/78; 208/80; 585/302; 585/300; 422/190; 422/196

[58] Field of Search ..... 208/78, 79, 80, 208/210; 585/302, 300; 422/190, 196

[56] References Cited

U.S. PATENT DOCUMENTS

| | | | |
|---|---|---|---|
| 3,005,770 | 10/1961 | Lutz | 208/140 |
| 3,159,565 | 12/1964 | Kimberlin et al. | 208/78 |
| 3,252,888 | 5/1966 | Langer, Jr. et al. | 208/56 |
| 3,364,134 | 1/1968 | Hamblin | 208/93 |
| 3,592,757 | 7/1971 | Baral | 208/58 |
| 3,649,518 | 3/1972 | Watkins | 208/59 |
| 3,649,519 | 3/1972 | Watkins | 208/78 |
| 3,691,059 | 9/1972 | Hallman | 208/80 |
| 3,753,891 | 8/1973 | Graven et al. | 208/62 |
| 3,775,293 | 11/1973 | Watkins | 208/86 |
| 3,928,174 | 12/1975 | Bonacci et al. | 208/80 |
| 4,082,647 | 4/1978 | Hutchings et al. | 208/80 |
| 4,197,184 | 4/1980 | Munro et al. | 208/89 |
| 4,875,991 | 10/1989 | Kukes et al. | 208/59 |
| 4,919,789 | 4/1990 | Fischer et al. | 208/61 |
| 4,943,366 | 7/1990 | Fischer et al. | 208/68 |
| 5,026,472 | 6/1991 | Hoehn et al. | 208/58 |
| 5,114,562 | 5/1992 | Haun et al. | 208/89 |
| 5,203,987 | 4/1993 | de la Fuente | 208/59 |
| 5,290,427 | 3/1994 | Fletcher et al. | 208/89 |
| 5,403,469 | 4/1995 | Vauk et al. | 208/78 |

*Primary Examiner*—Glenn Caidarola
*Assistant Examiner*—Thuan Dang
*Attorney, Agent, or Firm*—The M. W. Kellogg Company

[57] ABSTRACT

Hydrocarbon feedstocks are hydroprocessed in parallel reactors, while hydrogen flows in series between the reactors. A first hydrocarbon feedstock and a hydrogen-rich recycle gas stream are introduced to a first reactor, where a first reactor effluent stream is produced and fed to a first separator, which separates the first reactor effluent stream into a first hydrogen-rich gas stream and a first hydroprocessed product stream. The first hydrogen-rich gas stream and a second hydrocarbon feedstock are fed to a second reactor, where a second reactor effluent stream is produced and fed to a second separator, which separates the second reactor effluent stream into a second hydrogen-rich gas stream and a second hydroprocessed product stream. A make-up hydrogen stream is added to the second hydrogen-rich gas to form the hydrogen-rich recycle gas stream that is compressed and fed to the first reactor.

20 Claims, 3 Drawing Sheets

TWO-STAGE HYDROPROCESSING REACTION SCHEME WITH SERIES RECYCLE GAS FLOW

FIELD OF THE INVENTION

This invention relates to hydroprocessing of hydrocarbon streams, including hydrocracking and hydrotreating of such streams in a petroleum refinery or chemical plant.

BACKGROUND OF THE INVENTION

Hydrocarbon-based petroleum and synthetic oils derive from a variety of ultimate sources including crude oil, tar sands, shale oil, and liquefied coal-based compositions. Such oils are processed in refineries and chemical plants to remove undesired components and to chemically alter the hydrocarbon-based oils to manufacture streams having a higher value than the streams that either occur naturally or are delivered to processing equipment. Two such processes used in petroleum refineries are hydrotreating and hydrocracking.

A hydrotreating process typically reacts hydrogen, in the presence of a catalyst, with a hydrocarbon-based oil to convert organic sulfur and nitrogen compounds to hydrogen sulfide and ammonia, respectively, which can be relatively easily removed from the hydrocarbon-based oil stream. Various other reactions occur concurrently in the same reaction vessel including hydrogenation.

A hydrocracking process is similarly carried out in the presence of a catalyst, but typically at more severe conditions than used in hydrotreating. In particular, hydrocracking is typically carried out at a significantly higher pressure than hydrotreating and otherwise differs from hydrotreating in that an objective of hydrocracking is to break large molecules into smaller ones having a higher value.

Hydrogen is used in both processes, and since the processing units are operated at relatively high pressures, the capital and operating costs for compression are significant. Various inventions have been disclosed pertaining to the configuration of the processing units with respect to the hydrogen system, frequently with the objective of lowering capital and operating costs, while increasing the flexibility of the processing equipment.

U.S. Pat. No. 3,592,757 issued to Baral teaches a hydrofiner (essentially the same as a hydrotreater) operating in series with a hydrocracker, with a fraction of the product fed to a hydrogenator. A gas oil feed is fed with both make-up and recycle hydrogen to a hydrofiner. A recycle stream and additional recycle hydrogen are added to the hydrofiner product stream, and the mixture is fed to a hydrocracker. The hydrocracker product stream is cooled and separated into a vapor and a liquid stream. The vapor stream is passed to a recycle hydrogen compressor for recycle to the hydrofiner. The liquid stream is fractionated into top, mid, and bottom streams. The bottom stream is recycled to the hydrocracker. The mid stream is mixed with hydrogen from a make-up hydrogen compressor and directed to a hydrogenator. Hydrogen recovered from the hydrogenator is compressed in a stage of the make-up hydrogen compressor and directed to the hydrofiner.

U.S. Pat. No. 5,114,562 issued to Haun et al. teaches a two-stage hydrodesulfurization (essentially the same as a hydrotreatment) and hydrogenation process for distillate hydrocarbons. Two separate reaction zones are employed in series, a first for hydrodesulfurization and a second for hydrogenation. A feed is mixed with a recycled hydrogen and fed to a desulfurization reactor. Hydrogen sulfide is stripped from the desulfurization reactor product by a countercurrent flow of hydrogen. The liquid product stream from this stripping operation is mixed with relatively clean recycled hydrogen and the mixture fed to a hydrogenation reaction zone. Hydrogen is recovered from the hydrogenation reactor and recycled as a split stream to both the desulfurization reactor and the hydrogenation reactor. The hydrogen from the stripping operation is passed through a separator, mixed with the portion of the recycled hydrogen directed to the hydrogenation reactor, compressed, passed through a treating step, and recycled to the hydrogenation reactor. Thus, the hydrocarbon feed stream passes in series through the desulfurization and hydrogenation reactors, while relatively low pressure hydrogen is provided for the desulfurization step and relatively high pressure hydrogen is provided for the hydrogenation step.

U.S. Pat. No. 5,403,469 issued to Vauk et al. teaches a process for producing fluid catalytic cracking unit (FCCU) feed and middle distillate. Separate feed streams from a vacuum tower are processed in parallel by a hydrocracker and a hydrotreater, a relatively lighter feed stream in the hydrocracker and a relatively heavier feed stream in the hydrotreater. A common source of recycled and make-up hydrogen is fed in parallel to the hydrocracking and hydrotreating steps. The product streams from the hydrocracking and hydrotreating steps are separated into liquid and vapor streams in a common separator. Consequently, the hydrocracking and hydrotreating steps operate at the same pressure. This requires either the hydrotreating step to operate at a higher than optimum pressure and/or the hydrocracking step to operate at a lower than optimum pressure, since typically a hydrocracker is operated at a significantly higher pressure than a hydrotreater. With make-up hydrogen added to maintain pressure, recycle hydrogen is recycled from the common separator to a recycle gas compressor, which compresses the gas before parallel delivery to both the hydrocracker and the hydrotreater. In an alternative embodiment, the feed to the hydrocracker is a recycle stream from a fractionator that separates the combined product from the hydrotreater and the hydrocracker.

Although there have been many advances in this art, there remains a need for a parallel hydroprocessing configuration, where parallel reactors operate at different hydrogen partial pressures, but yet, capital and utility costs for compression are reduced relative to conventional configurations.

SUMMARY OF THE INVENTION

In the present invention hydrocarbon feedstock streams are hydroprocessed in parallel reactors with hydrogen flowing in series through the reactors. A first hydrocarbon feedstock, such as a light vacuum gas oil, is fed along with a recycle hydrogen-rich stream to a first reactor, such as a hydrocracker. First reactor effluent is separated into a first hydrogen-rich stream and a first reactor product stream. A second hydrocarbon feedstock, such as a heavy vacuum gas oil, is fed along with the first hydrogen-rich stream to a second reactor, such as a hydrotreater. Second reactor effluent is separated into a second hydrogen-rich stream and a second reactor product stream. Make-up hydrogen is added to the second hydrogen-rich stream, and the combination is compressed and recycled to form the recycle hydrogen stream.

In one aspect, the invention provides a process for parallel hydroprocessing of first and second hydrocarbon feedstocks with series flow hydrogen recycle. The process comprises the steps of: hydroprocessing the first hydrocarbon feedstock with a hydrogen-rich recycle gas stream in a first catalytic reactor zone to form a first reactor effluent stream; separating the first reactor effluent stream to form a first hydrogen-rich gas stream and a first hydroprocessed product stream; hydroprocessing the second hydrocarbon feedstock with the first hydrogen-rich gas stream in a second catalytic reactor zone, at a lower hydrogen partial pressure than the first reactor zone, to form a second reactor effluent stream; separating the second reactor effluent stream to form a second hydrogen-rich gas stream and a second hydroprocessed product stream; compressing the second hydrogen-rich gas stream; and adding a make-up hydrogen stream to the second hydrogen-rich gas stream to form the hydrogen-rich recycle gas stream for the hydroprocessing in the first reactor zone. The make-up hydrogen stream can be added to the second hydrogen-rich gas stream either before or after the compression step.

In one embodiment, the first hydrocarbon feedstock is preferably a vacuum gas oil fraction having a boiling range above about 750° F., and the second hydrocarbon feedstock is preferably a vacuum gas oil fraction having a boiling range below about 950° F.

In another embodiment, the parallel hydroprocessing process can further include the steps of fractionating the first and second hydroprocessed product streams in a common fractionator and recycling a fractionator product stream to the first catalytic reactor zone.

In another aspect, the invention provides a hydroprocessing plant for parallel hydroprocessing of first and second hydrocarbon feedstocks with series flow hydrogen recycle. The hydroprocessing plant comprises: first and second hydrocarbon feedstock streams; a first catalytic reactor zone for hydroprocessing the first hydrocarbon feedstock stream with a recycle hydrogen-rich gas stream; a first separator or series of separators for separating an effluent stream from the first reactor zone into a first hydrogen-rich gas stream and a first hydroprocessed product stream; a second catalytic reactor zone for hydroprocessing the second hydrocarbon feedstock stream with the first hydrogen-rich gas stream; a second separator or series of separators for separating an effluent stream from the second reactor zone into a second hydrogen-rich gas stream and a second hydroprocessed product stream; a make-up hydrogen stream for adding make-up hydrogen to the second hydrogen-rich gas stream; and a compressor for compressing the second hydrogen-rich gas stream to the first reactor zone as the recycle hydrogen-rich gas stream.

In one embodiment, the hydroprocessing plant preferably includes a vacuum gas oil fractionator for producing a heavy fraction having a boiling range above about 750° F. and a light fraction having a boiling range below about 950° F.; a line for supplying the light vacuum gas oil fraction to the first reaction zone as the first hydrocarbon feedstock stream; and a line for supplying the heavy vacuum gas oil fraction to the second reaction zone as the second hydrocarbon feedstock stream.

In an alternative embodiment, the hydroprocessing plant preferably includes a fractionation column for receiving and fractionating the first and second hydroprocessed product streams into a plurality of fractionator product streams; and a line for recycling at least one fractionator product stream to the first hydrocarbon feedstock stream.

In another aspect, the invention provides an improvement in a process comprising parallel hydroprocessing of first and second hydrocarbon feedstock streams in first and second respective reaction zones, and separating effluents from the reaction zones to form at least one hydroprocessed liquid product and hydrogen-rich recycle gas. The improvement comprises: separating the hydroprocessed effluents in separate first and second separators to form respective first and second hydrogen-rich gas streams and first and second hydroprocessed liquid product streams; operating the second reaction zone at a lower hydrogen partial pressure with respect to hydrogen partial pressure of the first reaction zone; supplying the first hydrogen-rich gas stream from the first separator to the second reaction zone to substantially satisfy hydrogen requirements for the second reaction zone; and adding make-up hydrogen to and compressing the second hydrogen-rich gas stream from the second separator for feed to the first reaction zone. The make-up hydrogen can be added to the second hydrogen-rich gas stream on either the suction or discharge side of the compressor.

In another embodiment, the improvement preferably includes fractionating the first and second hydroprocessed product streams in a common fractionator and recycling a fractionator product stream to the first catalytic reactor zone.

In one embodiment, the first hydrocarbon feedstock stream is preferably a vacuum gas oil fraction having a boiling range above about 750° F., and the second hydrocarbon feedstock stream is preferably a vacuum gas oil fraction having a boiling range below about 950° F.

In additional embodiments, the first hydrocarbon feedstock stream is preferably a full range vacuum gas oil fraction having a boiling range of approximately 600° F. to 1100° F., and the second hydrocarbon feedstock stream is preferably a heavy gas oil derived from one or more various residuum processing methods such as solvent deasphalting, delayed coking, visbreaking, thermal cracking and the like.

DETAILED DESCRIPTION OF THE INVENTION

Figure 1:
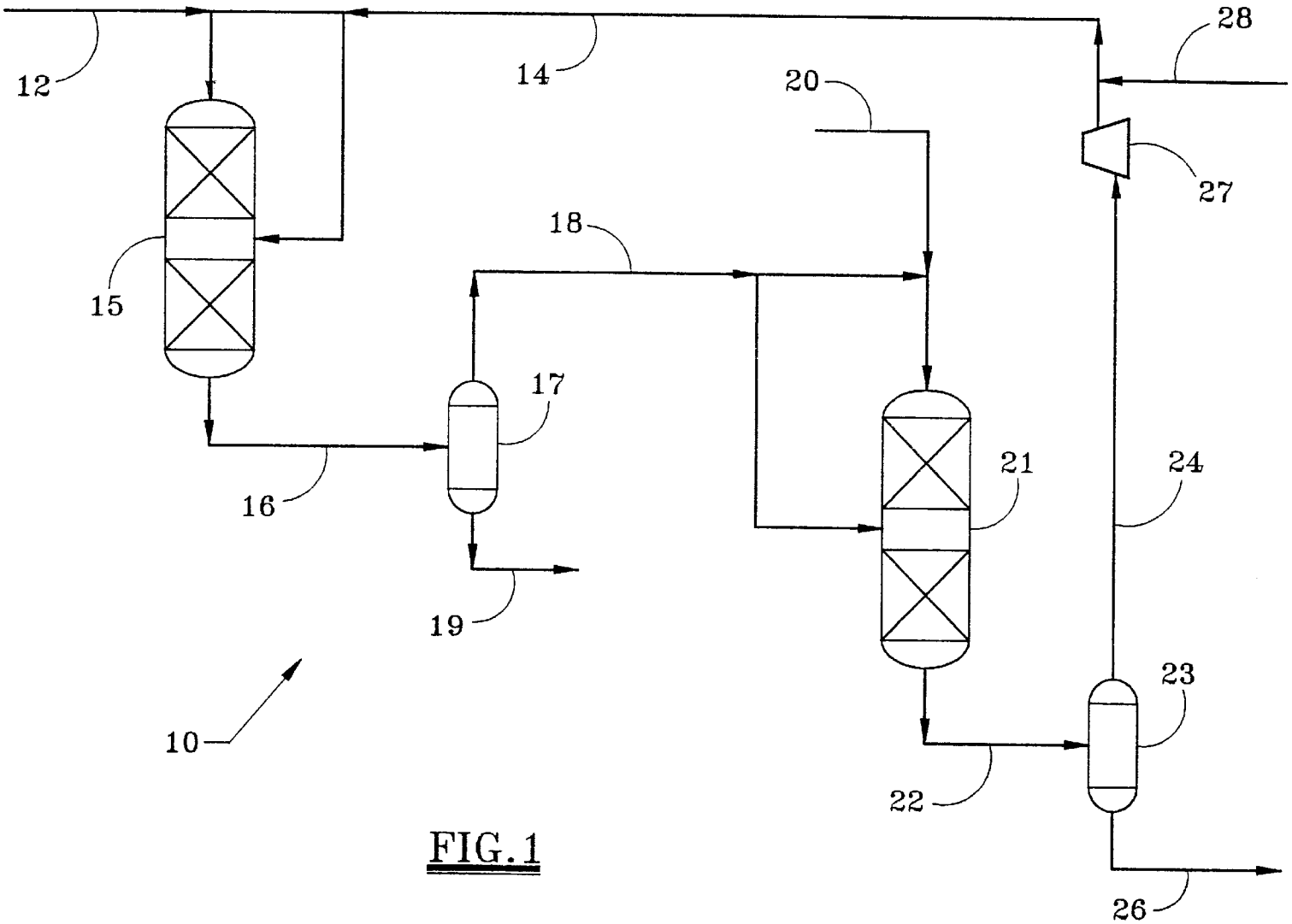
FIG. 1 is a simplified process flow diagram for parallel hydroprocessing of hydrocarbon feedstocks in first and second catalytic reactors, using hydrogen flowing in a series recycle loop through the first and then the second reactor, after which it is compressed, along with make-up hydrogen, and recycled to the first reactor.
Figure 2:
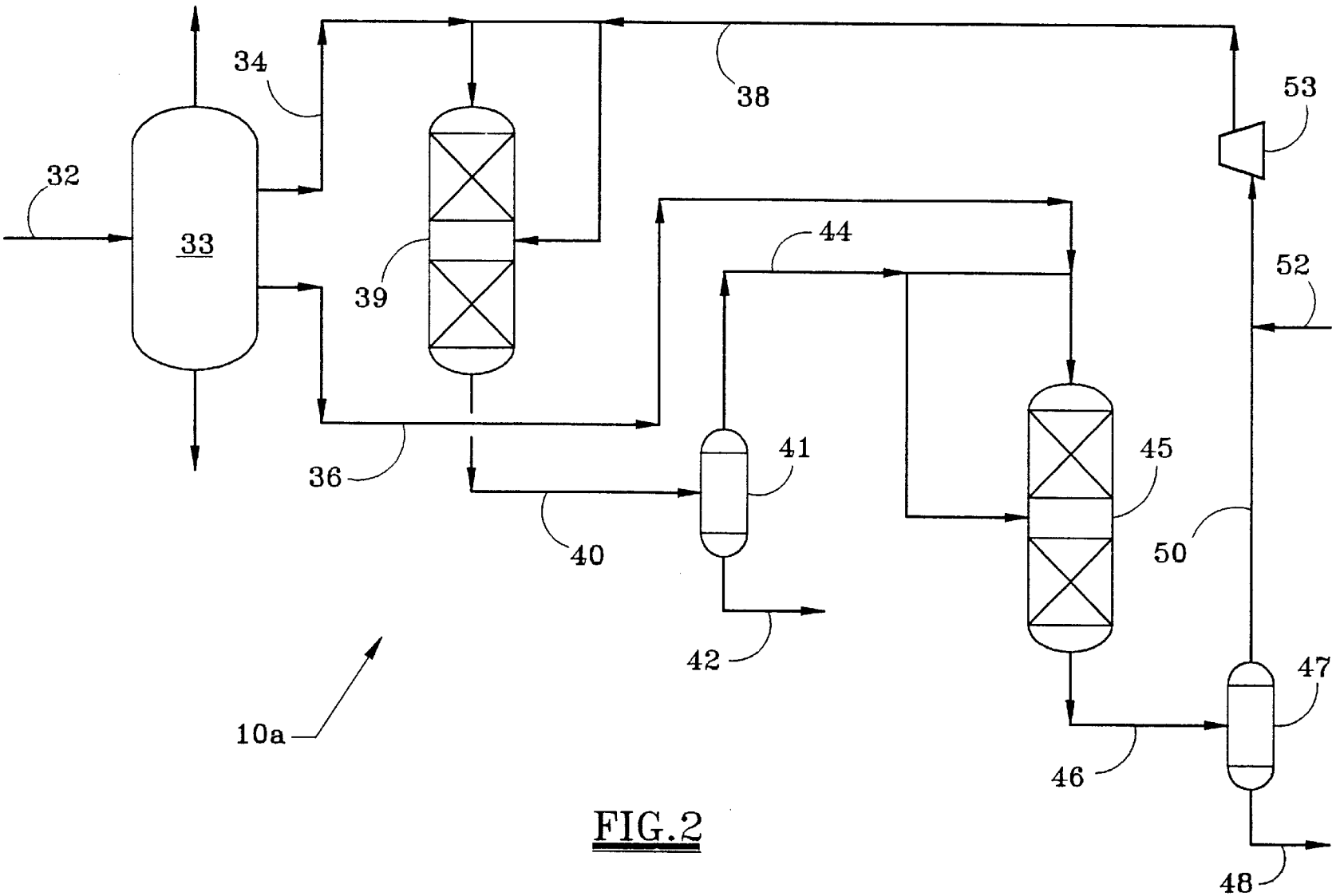
FIG. 2 is a simplified process flow diagram for parallel hydrocracking and hydrotreating of vacuum gas oil streams in an application for upgrading atmospheric residuum.
Figure 3:
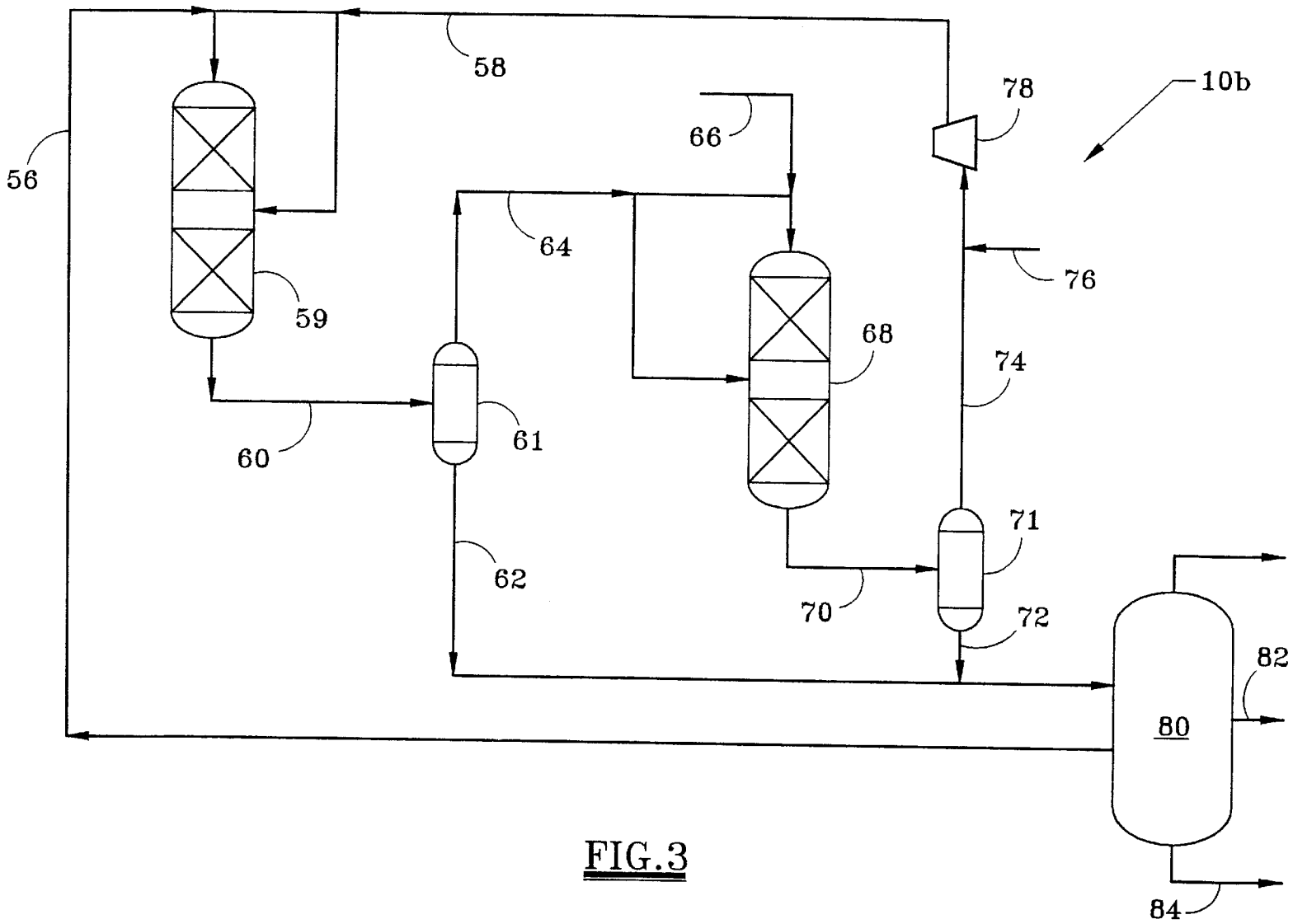
FIG. 3 is a simplified process flow diagram for hydrotreating an atmospheric residuum or vacuum gas oil stream and hydrocracking a recycle stream from a common fractionation of the hydrotreater and hydrocracker product streams, an application that emphasizes production of middle distillates.

Parallel hydroprocessing reactor configurations using a series hydrogen recycle loop are illustrated in FIGS. 1–3. The term "hydrocarbon" as used herein refers broadly to any compound containing both hydrogen and carbon and includes liquid, vapor and combined liquid/vapor streams containing greater than about 90 weight percent hydrogen and carbon, calculated as the elements.

With reference to FIG. 1, in a parallel hydroprocessing process 10, a first hydrocarbon feedstock 12 and a hydrogen-rich recycle gas stream 14 are introduced to a first catalytic reactor zone 15. A first reactor effluent stream 16 is produced in the first catalytic reactor zone 15 and fed to a first separator 17. The first separator 17 separates the first reactor effluent stream 16 into a vapor first hydrogen-rich gas stream 18 and a liquid first hydroprocessed product stream 19.

The first hydrogen-rich gas stream 18 and a second hydrocarbon feedstock 20 are fed to a second catalytic reactor zone 21. A second reactor effluent stream 22 is produced in the second catalytic reactor zone 21 and fed to a second separator 23. The second separator 23 separates the second reactor effluent stream 22 into a vapor second hydrogen-rich gas stream 24 and a liquid second hydroprocessed product stream 26.

The second hydrogen-rich gas stream 24 is compressed in a compressor 27 and a make-up hydrogen stream 28 is added to form the hydrogen-rich recycle gas stream 14 that is fed to the first catalytic reactor zone 15. Alternatively, the make-up hydrogen stream 28 can be added to the second hydrogen-rich gas stream 24 on the suction side of the compressor 27 to form the hydrogen-rich recycle gas stream 14.

The first and second catalytic reactor zones 15 and 21 can be any hydroprocessing reactor conventionally used in refinery and chemical plant units, such as, for example, hydrotreating (including hydrodesulfurization and hydrodenitrogenation), hydrocracking, hydrogenation, isomerization, aromatics saturation, dewaxing, and like reactors. Hydrocarbon compounds that can be converted in the first and second catalytic reactor zones 15 and 21 include organosulfur, organonitrogen, and organometallic compounds, and olefinic, aromatic, aliphatic, cycloaliphatic, acetylenic, alkaryl and arylalkyl aromatic compounds and derivatives thereof. If desired, the reactor zones 15 and 21 can comprise a plurality of stages or beds with interstage injection of hydrogen-rich gas from lines 14 and 18, respectively.

The two-stage hydroprocessing reaction scheme with series recycle gas flow illustrated generally in FIG. 1 has a number of uses and advantages. The first catalytic reactor zone 15 and the second catalytic reactor zone 21 operate at different hydrogen partial pressures, since hydrogen-rich gas flows in series from the higher-pressure first catalytic reactor zone 15 to the lower-pressure second catalytic reactor zone 21. This provides flexibility to match hydrocarbon feedstocks with an appropriate hydrogen partial pressure.

Proper balancing of hydrocarbon feedstocks with proper hydrogen partial pressures provides efficient consumption of hydrogen to yield desired products. The relative flow rates of the hydrogen-rich recycle gas stream 14 and the first hydrogen-rich gas stream 18 can be balanced to reduce recycle gas rates.

The series arrangement of hydrogen flow reduces compressor investment capital requirements, while at the same time reducing compressor operating costs. A single compressor can provide hydrogen to the first catalytic reactor zone at a relatively higher pressure and higher purity and to the second catalytic reactor zone at a relatively lower pressure and lower purity, without, for example, an inefficient let-down in pressure across a control valve.

Operating conditions can be varied to suit the feedstocks. The optimum conditions will depend on the feedstock and the desired product attributes. Key operating parameters of the reactors include pressure, temperature, liquid hourly space velocity and relative flow rates of the hydrogen and hydrocarbon streams. With reference to FIG. 1, the first and second catalytic reactor zones 15 and 21 are typically operated between 50 and 4000 psig; 100 and 1000° F.; 0.05 to 25 volume/volume-hr; and 500 to 15,000 scf hydrogen/bbl hydrocarbon feed. The hydrogen purity in the hydrogen-rich recycle gas stream 14 is typically greater than 65 volume percent, and in the first hydrogen-rich gas stream 18, the hydrogen purity is typically greater than 50 volume percent.

With reference to FIG. 2, a preferred embodiment of the present invention is shown. In a parallel hydroprocessing process 10*a*, a feed 32, such as atmospheric residuum from crude oil distillation, is fed to a vacuum tower 33, where it is fractionated into a light vacuum gas oil fraction 34 and a heavy vacuum gas oil fraction 36. The light vacuum gas oil fraction 34 typically has an ASTM 95% off point below about 950° F., and the heavy vacuum gas oil fraction 36 typically has an ASTM 5% off point above about 750° F.

The light vacuum gas oil fraction 34 and a recycle hydrogen stream 38 are fed to a hydrocracker 39 to produce a hydrocracker effluent stream 40, which is fed to a hydrocracker effluent separator 41. The hydrocracker effluent stream 40 is separated into a hydrocracker product stream 42 and a hydrocracker effluent hydrogen stream 44. The hydrocracker effluent hydrogen stream 44 is fed along with the heavy vacuum gas oil fraction 36 to a hydrotreater 45 to produce a hydrotreater effluent stream 46, which is fed to a hydrotreater effluent separator 47. The hydrotreater effluent stream 46 is separated into a hydrotreater product stream 48 and a hydrotreater effluent hydrogen stream 50. A make-up hydrogen stream 52 is added to the hydrotreater effluent hydrogen stream 50 and compressed in compressor 53 to form the recycle hydrogen stream 38 for recycle to the hydrocracker 39. A pressure controller (not shown) can be used to add the make-up hydrogen stream 52. Alternatively, if the make-up hydrogen stream 52 is available at a sufficiently high pressure, then it can be added to the hydrotreater effluent hydrogen stream 50 on the discharge side of the compressor 53. In either case, hydrogen purity can be monitored in the recycle hydrogen stream 38 to control hydrogen partial pressure and relative flow rates of the hydrogen and hydrocarbon streams.

With reference to FIG. 2, the hydrocracker 39 and the hydrotreater 45 are typically operated between 200 and 4000 psig; 500 and 900° F.; 0.05 to 10 volume/volume-hr; and 500 to 15,000 scf hydrogen/bbl hydrocarbon feed. The hydrogen purity in the recycle hydrogen stream 38 is typically greater than 65 volume percent, and in the hydrocracker effluent hydrogen stream 44, the hydrogen purity is typically greater than 50 volume percent.

Preferably, the hydrocracker 39 is operated between 700 and 2,500 psig; 600 to 850° F.; 0.1 to 5 volume/volume-hr; and 1,000 to 10,000 scf hydrogen/bbl hydrocarbon feed, and the hydrotreater 45 is operated between 300 and 1,500 psig; 500 to 800° F.; 0.1 to 5 volume/volume-hr; and 1,000 to 10,000 scf hydrogen/bbl hydrocarbon feed.

With reference to FIG. 3, an alternative embodiment of the present invention is shown. In a parallel hydroprocessing process 10*b*, a recycle feed stream 56 and a recycle hydrogen stream 58 are fed to a hydrocracker 59 to produce a hydrocracker effluent stream 60, which is fed to a hydrocracker effluent separator 61. The hydrocracker effluent stream 60 is separated into a hydrocracker product stream 62 and a hydrocracker effluent hydrogen stream 64. The hydrocracker effluent hydrogen stream 64 and a fresh feed stream 66, such as, for example, an atmospheric residuum from crude oil distillation or a vacuum gas oil, are fed to a hydrotreater 68 to produce a hydrotreater effluent stream 70, which is fed to a hydrotreater effluent separator 71. The hydrotreater effluent stream 70 is separated into a hydrotreater product stream 72 and a hydrotreater effluent hydrogen stream 74. A make-up hydrogen stream 76 is added to the hydrotreater effluent hydrogen stream 74 and compressed in a compressor 78 to form the recycle hydrogen stream 58 for recycle to the hydrocracker 59. Alternatively, if the make-up hydrogen stream 76 is available at a sufficiently high pressure, then it can be added to the hydrotreater effluent hydrogen stream 74 on the discharge side of the compressor 78.

The hydrotreater product stream 72 and the hydrocracker product stream 62 are fed in combination to a fractionator 80. The fractionator 80 separates its feed into at least two fractions, one of the fractions being the recycle feed stream 56 that was fed to the hydrocracker 59. Other fractions can be drawn from the fractionator 80 as product streams. For example, a middle distillate product stream 82, such as jet or diesel fuel and a bottom product stream 84 can be drawn from the fractionator. The bottom product stream 84 is typically suitable for feed to a fluid catalytic cracking unit or can also be recycled for further conversion on the hydrocracker 59.

The operating conditions for the hydrocracker and hydrotreater in FIG. 3 are approximately equivalent to the operating conditions provided with reference to FIG. 2. The processing configuration in FIG. 3 is advantageous in that the recycle configuration provides a higher yield of middle distillates than does once-through processing.

EXAMPLE

A study was conducted comparing computer-based simulations of the parallel hydrocracking and hydrotreating of vacuum gas oils in parallel reactor stages. The first design comprises the use of parallel hydrogen recycle, such as described in U.S. Pat. No. 5,403,469 issued to Vauk et al., and the second design comprises the use of series hydrogen recycle as shown in FIG. 1 of the present invention. Calculations were performed based on hydrocracking 15,000 barrels per day of vacuum gas oil and hydrotreating 30,000 barrels per day of vacuum gas oil under commercially viable pressure levels. As can be seen in the Table below, both designs deliver equivalent hydrogen-to-oil ratios at the reactor inlets. The design based on the present invention results in substantially lower total gas circulation (100,085 SCFM versus 212,885 SCFM) and lower compression costs (3,289 HP versus 3,923 HP), even though the total pressure drop requirement is higher (425 psi versus 255 psi). The design based on the present invention also results in lower reactor design pressure for the hydrotreater reactor stage (1275 psi versus 1500 psi), allowing for decreased investment and installation cost for the facilities and also for minimized hydrogen consumption.

The results of the study are summarized in the table below.

TABLE

| | Parallel Hydrogen Recycle | Series Hydrogen Recycle (FIG. 1) |
|---|---|---|
| Hydrocracker Stage | | |
| Reactor Feed (B/D) | 15,000 | 15,000 |
| Inlet Gas/Oil Ratio (SCF/BBL) | 6,000 | 5,325 |
| Inlet H2/Oil Ratio (SCF/BBL) | 4,770 | 4,770 |
| Inlet Total Pressure (PSIG) | 1,500 | 1,500 |
| Inlet Partial Pressure (PSIA) | 1,200 | 1,360 |

TABLE-continued

| | Parallel Hydrogen Recycle | Series Hydrogen Recycle (FIG. 1) |
|---|---|---|
| Hydrotreater Stage | | |
| Reactor Feed (B/D) | 30,000 | 30,000 |
| Inlet Gas/Oil Ratio (SCF/BBL) | 3,600 | 3,670 |
| Inlet H2/Oil Ratio (SCF/BBL) | 2,810 | 2,870 |
| Inlet Total Pressure (PSIG) | 1,500 | 1,275 |
| Inlet Partial Pressure (PSIA) | 1,180 | 1,010 |
| Recycle Compressor | | |
| Recycle Rate (SCFM) | 212,885 | 100,085 |
| Suction Pressure (PSIG) | 1,275 | 1,105 |
| Discharge Pressure (PSIG) | 1,530 | 1,530 |
| Delta Pressure (PSI) | 255 | 425 |
| Compression Horsepower | 3,923 | 3,289 |

The present invention is illustrated by way of the foregoing description and example. Various modifications will be apparent to those skilled in the art in view thereof. It is intended that all such variations within the scope and spirit of the appended claims be embraced thereby.

We claim:

1. A process for parallel hydroprocessing of hydrocarbon with series flow hydrogen recycle, comprising the steps of:

hydroprocessing a hydrocarbon product stream from a single common multistage fractionator with a hydrogen-rich recycle gas stream in a first catalytic reactor zone to form a first reactor effluent stream;

separating the first reactor effluent stream to form a first hydrogen-rich gas stream and a first hydroprocessed product stream;

hydroprocessing a hydrocarbon feedstock with the first hydrogen-rich gas stream in a single pass in a second catalytic reactor zone, at a substantially lower hydrogen partial pressure than the first reactor zone so as not to require compression of the first hydrogen-rich gas stream, wherein the first hydrogen-rich gas stream is the sole source of hydrogen in the hydroprocessing of the hydrocarbon feedstock, to form a second reactor effluent stream;

separating the second reactor effluent stream to form a second hydrogen-rich gas stream and a second hydroprocessed product stream;

adding a make-up hydrogen stream to the second hydrogen-rich gas stream to form the hydrogen-rich recycle gas stream;

compressing the hydrogen-rich recycle gas stream for the hydroprocessing in the first reactor zone wherein the process is free of other hydrogen compression;

fractionating the first and second hydroprocessed product streams together in said single common multistage fractionator to produce a plurality of fractionator product streams including a sidestream; and supplying the sidestream to the first catalytic reactor zone for said hydroprocessing thereof.

2. The process of claim 1, wherein the single common multistage fractionator product stream supplied to the first catalytic reactor zone has a boiling range above about 750° F., and the hydrocarbon feedstock comprises a vacuum gas oil fraction having a boiling range below about 950° F.

3. The process of claim 1, wherein the single common multistage fractionator product stream supplied to the first catalytic reactor zone has a boiling range between about 600° F. and about 1100° F., and the hydrocarbon feedstock comprises a heavy gas oil fraction derived from solvent deasphalting.

4. The process of claim 1, wherein the single common multistage fractionator product stream supplied to the first catalytic reactor zone has a boiling range between about 600° F. and about 1100° F., and the hydrocarbon feedstock comprises a heavy gas oil fraction derived from a coking process.

5. The process of claim 1, wherein the common fractionator product stream supplied to the first catalytic reactor zone has a boiling range between about 600° F. and about 1100° F., and the hydrocarbon feedstock comprises a heavy gas oil fraction derived from visbreaking.

6. The process of claim 1, wherein the single common multistage fractionator product stream supplied to the first catalytic reactor zone has a boiling range between about 600° F. and about 1100° F., and the hydrocarbon feedstock comprises a heavy gas oil fraction derived from thermal cracking.

7. The process of claim 1 wherein the hydroprocessing steps are single-pass with respect to the hydrogen-rich recycle gas stream and the first hydrogen-rich gas stream.

8. The process of claim 1 wherein the hydroprocessed hydrocarbon product stream and the hydroprocessed hydrocarbon feedstock have a higher elemental hydrogen content than the respective hydrocarbon product stream and hydrocarbon feedstock.

9. A hydroprocessing plant for parallel hydroprocessing of hydrocarbon with series flow hydrogen recycle, comprising:

a hydrocarbon feedstock stream;

a first catalytic reactor zone for hydroprocessing a single common multistage fractionator product stream with a recycle hydrogen-rich gas stream;

a first separator for separating an effluent stream from the first reactor zone into a first hydrogen-rich gas stream and a first hydroprocessed product stream;

a second catalytic reactor zone for hydroprocessing the hydrocarbon feedstock stream with the first hydrogen-rich gas stream in a single pass at a hydrogen partial pressure substantially lower than in the first catalytic reactor zone so as not to require compression of the first hydrogen-rich stream, wherein the first hydrogen-rich stream is the sole source of hydrogen in the second catalytic reactor zone;

a second separator for separating an effluent stream from the second reactor zone into a second hydrogen-rich gas stream and a second hydroprocessed product stream;

a make-up hydrogen stream for adding make-up hydrogen to the second hydrogen-rich gas stream;

a compressor for compressing the second hydrogen-rich gas stream to a pressure of the first catalytic reactor zone as the recycle hydrogen-rich gas stream;

a single common multistage fractionator for receiving and fractionating together the first and second hydroprocessed product streams into a plurality of single fractionator product streams including a sidestream; and a line for supplying the sidestream to the first catalytic reactor zone.

10. The process of claim 9 wherein the first and second hydroprocessed product streams have a higher elemental hydrogen content than the respective single common fractionator product stream and the hydrocarbon feedstock stream.

11. In a process comprising parallel hydroprocessing of first and second hydrocarbon streams in first and second respective reaction zones, and separating effluents from the reaction zones to form at least one hydroprocessed liquid product and a hydrogen-rich recycle gas, the improvement comprising:

separating the hydroprocessed effluents in separate first and second separators to form respective first and second hydrogen-rich gas streams and first and second hydroprocessed liquid product streams;

operating the second reaction zone at a substantially lower hydrogen partial pressure with respect to hydrogen partial pressure of the first reaction zone;

supplying the first hydrogen-rich gas stream from the first separator to the second reaction zone in a single pass to substantially satisfy hydrogen requirements for the second reaction zone;

adding make-up hydrogen to and then compressing the second hydrogen-rich gas stream from the second separator for feed to the first reaction zone, wherein the compression of the second hydrogen-rich gas stream is the sole compression of hydrogen in the improved process;

fractionating the first and second hydroprocessed product streams together in a common multistage fractionator; and supplying a sidestream from the common multistage fractionator as the first hydrocarbon stream to the first catalytic reactor zone wherein the sidestream is the sole feed to the first catalytic reactor zone and wherein a fresh hydrocarbon feedstock is the sole feed to the second reactor zone.

12. The improvement of claim 11, wherein the second hydrogen-rich gas stream is compressed before make-up hydrogen is added.

13. The improvement of claim 11, wherein the first hydrocarbon stream has a boiling range above about 750° F., and the second hydrocarbon stream comprises a vacuum gas oil fraction having a boiling range below about 950° F.

14. The improvement of claim 11, wherein the first hydrocarbon stream has a boiling range between about 600° F. and about 1100° F., and the second hydrocarbon stream comprises a heavy gas oil fraction derived from solvent deasphalting.

15. The improvement of claim 11, wherein the first hydrocarbon stream has a boiling range between about 600° F. and about 1100° F., and the second hydrocarbon stream comprises a heavy gas oil fraction derived from a coking process.

16. The improvement of claim 11, wherein the first hydrocarbon stream has a boiling range between about 600° F. and about 1100° F., and the second hydrocarbon stream comprises a heavy gas oil fraction derived from visbreaking.

17. The improvement of claim 11, wherein the first hydrocarbon stream has a boiling range between about 600° F. and about 1100° F., and the second hydrocarbon stream comprises a heavy gas oil fraction derived from thermal cracking.

18. The improvement of claim 11 wherein the feed of the second hydrogen-rich gas stream to the first reaction zone is single pass so as not to require recompression thereof.

19. A process for parallel hydroprocessing of hydrocarbon with series flow hydrogen recycle, comprising the steps of:

fractionating a hydrocarbon feedstock stream into relatively light and heavy fractionator product streams;

hydroprocessing the light fractionator product stream with a hydrogen-rich recycle gas stream in a single pass as the sole source of hydrogen in a first catalytic reactor zone to form a first reactor effluent stream;

separating the first reactor effluent stream to form a first hydrogen-rich gas stream and a first hydroprocessed product stream;

hydroprocessing the heavy fractionator product stream with the first hydrogen-rich gas stream in a single pass as the sole source of hydrogen in a second catalytic reactor zone, at a lower hydrogen partial pressure than the first reactor zone, to form a second reactor effluent stream;

separating the second reactor effluent stream to form a second hydrogen-rich gas stream and a second hydroprocessed product stream; and adding a make-up hydrogen stream to the second hydrogen-rich gas stream and then compressing the second hydrogen-rich gas stream to form the hydrogen-rich recycle gas stream.

20. A hydroprocessing plant for parallel hydroprocessing with series flow hydrogen recycle, comprising:

a fractionator for fractionating a hydrocarbon feedstock stream into relatively light first and heavy second hydrocarbon streams;

a first catalytic reactor zone for hydroprocessing the first hydrocarbon stream with a single pass of a recycle hydrogen-rich gas stream as the sole source of hydrogen;

a first separator for separating an effluent stream from the first reactor zone into a first hydrogen-rich gas stream and a first hydroprocessed product stream;

a second catalytic reactor zone for hydroprocessing the second hydrocarbon stream with a single pass of the first hydrogen-rich gas stream as the sole source of hydrogen at a hydrogen partial pressure lower than in the first catalytic reactor zone;

a second separator for separating an effluent stream from the second reactor zone into a second hydrogen-rich gas stream and a second hydroprocessed product stream;

a make-up hydrogen stream for adding make-up hydrogen to the second hydrogen-rich gas stream;

a compressor for compressing the second hydrogen-rich gas stream after the addition of the make-up hydrogen and supplying the compressed second hydrogen-rich gas stream to the first reactor zone as the recycle hydrogen-rich gas stream.

* * * * *